US006412562B1

(12) United States Patent
Shaw

(10) Patent No.: US 6,412,562 B1
(45) Date of Patent: Jul. 2, 2002

(54) ELECTRICAL SUBMERSIBLE PUMPS IN THE RISER SECTION OF SUBSEA WELL FLOWLINE

(75) Inventor: Christopher K. Shaw, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/657,261

(22) Filed: Sep. 7, 2000

(51) Int. Cl.[7] ..... E21B 43/01
(52) U.S. Cl. ..... 166/335; 166/105; 166/106
(58) Field of Search ..... 166/335, 105, 166/106

(56) References Cited

U.S. PATENT DOCUMENTS

| | | | | |
|---|---|---|---|---|
| 3,292,695 A | | 12/1966 | Haeber | |
| 4,805,697 A | | 2/1989 | Fouillout et al. | |
| 4,813,495 A | * | 3/1989 | Leach | 166/358 |
| 4,705,114 A | | 11/1989 | Schroeder et al. | |
| 4,900,433 A | * | 2/1990 | Dean et al. | 166/105.5 |
| 5,044,440 A | | 9/1991 | Stinessen et al. | 166/344 |
| 5,207,810 A | | 5/1993 | Sheth | 55/406 |
| 5,474,601 A | * | 12/1995 | Choi | 166/105.3 |
| 5,755,288 A | | 5/1998 | Bearden et al. | 166/370 |
| 6,142,236 A | * | 11/2000 | Brammer et al. | 166/351 |
| 6,325,159 B1 | * | 12/2001 | Peterman et al. | 166/350 |

FOREIGN PATENT DOCUMENTS

GB 2133446 A 7/1984

* cited by examiner

*Primary Examiner*—Hoang Dang
(74) *Attorney, Agent, or Firm*—Bracewell & Patterson, L.L.P.

(57) ABSTRACT

A riser is installed which extends from a wellhead near the sea floor to near sea level. An electrical submersible pump assembly is suspended within the riser to pump well fluids up the riser. The electrical submersible pump includes impellers for displacing well fluids, and a base member having an intake port for receiving well fluid. The pump assembly can also include a separator for separating any gases from the well fluids, a packer for sealing the pump to the riser, coiled tubing from the pump to at least the upper end of the riser, or NPSH stages to aid in pumping a mixed flow of well fluids and gas.

20 Claims, 3 Drawing Sheets

ELECTRICAL SUBMERSIBLE PUMPS IN THE RISER SECTION OF SUBSEA WELL FLOWLINE

TECHNICAL FIELD

This invention relates in general to electrical submersible well pumps, and in particular to a electrical submersible pump inside the riser. More particularly, the device is useful in wells currently using conventional gas-lift.

BACKGROUND OF THE INVENTION

Devices have been proposed to boost the pressure and flow in a producing well. An example of such a device is described in U.S. Pat. No. 5,044,440, which utilizes an underwater separating, compressing, and pumping station that sits on the ocean floor to boost the flow of a well or a number of wells. Another device, described in U.S. Pat. No. 5,755,288, is a downhole gas compressor assembly that includes a separator, a compressor, and a pump that is located at the production zone by the perforations in the well.

Offshore wells are now being drilled in very deep water. Delivering the produced well fluid from the top of a well at the sea floor, through thousands of feet of riser requires extensive energy. Gas lift has been proposed, but this requires a high injection pressure and a large compressor on a production platform at the surface.

SUMMARY OF THE INVENTION

According to the present invention, a submersible pump of the type that would normally be applied to a downhole well application can be installed within the oil production riser pipes of a composite or steel riser system above the sea floor, or any other new deepwater riser configuration. The pump could be electrically or hydraulically powered, or utilize another energy source.

The pump assembly is comprised of an intake for oil, water, and gas outfitted with a check valve to insure against reverse flow. The fluids and gases are then fed into a gas through pump or a separator and then the liquids are sent to a pump. The liquids leave the pump outlet and are sent to the surface by the riser. Gas is vented in the annular space between the riser and the production tubing.

BEST MODE FOR CARRYING OUT THE INVENTION

Figure 1:
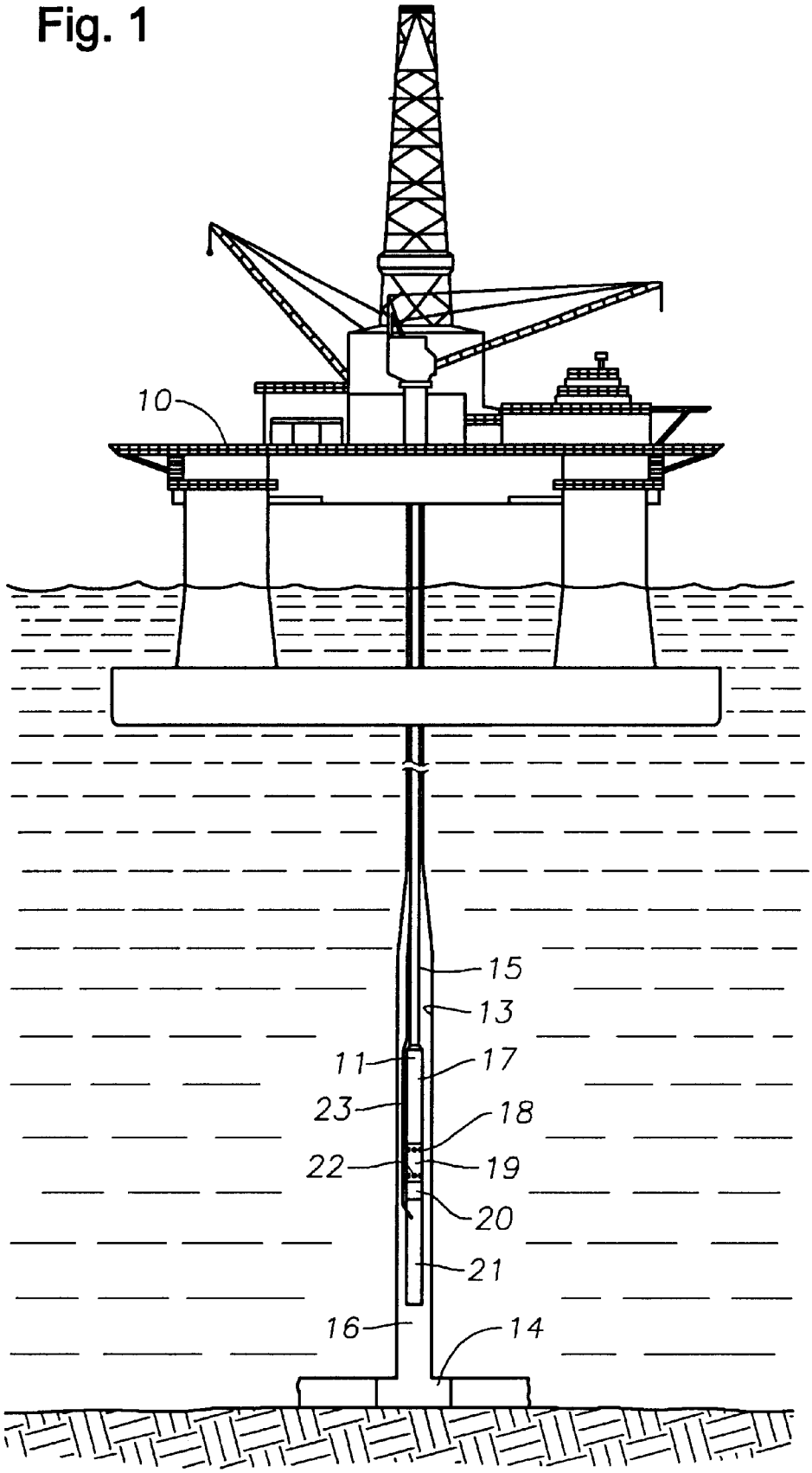
FIG. 1 is a schematic view illustrating an electrical submersible pump assembly installed in a well riser in accordance with this invention.

Referring to FIG. 1, an electrical submersible pump assembly 11 is shown installed within a riser 13 of a well below a floating production platform 10 and above a wellhead 14 at the sea floor. A floating production ship could also be used instead of the floating production platform 10. Wellhead 14 may be conventional and include remotely actuated valves for controlling the flow of well fluid into riser 13. Wellhead 14 may accumulate the production from a number of wells, or the wellhead may only be connected to a single well. Riser 13 contains a well fluid 16 which flows upward from a production region (not shown). In the application of this invention, well fluid 16 will typically be a heavy viscous crude and gas mixture. Pump assembly 11 will preferably be located deep within riser 13, preferably 0–100 meters above wellhead 14, more preferably 0–50 meters above wellhead 14, and most preferably 0–25 meters above wellhead 14. Riser 13 may be thousands of meters long, thus pump assembly 11 is closer in distance to wellhead 14 than to production platform 10.

Pump assembly 11 includes a centrifugal pump 17 which is suspended in riser 13 by a string of production tubing 15 and a rotating gas separator 19 that is mounted to a lower end of pump 17 in this embodiment. Rotating gas separator 19 has a well fluid inlet or lower intake 22 and an upper gas outlet 18. Gas separator 19 at its lower end is mounted to a conventional seal section 20. An electrical motor 21 is supported on the lower end of seal section 20. Seal section 20 seals well fluid 16 from lubricant within electrical motor 21 and also reduces the pressure differential between the hydrostatic pressure in the well and the internal pressure of the lubricant in the motor. Additionally, seal section 20 has thrust bearings for absorbing axial thrust generated by pump 17 and rotating gas separator 19. Electrical motor 21 is a large AC motor which is supplied with electrical power through a power cable 23 extending down from the floating production platform 10.

Figure 2:
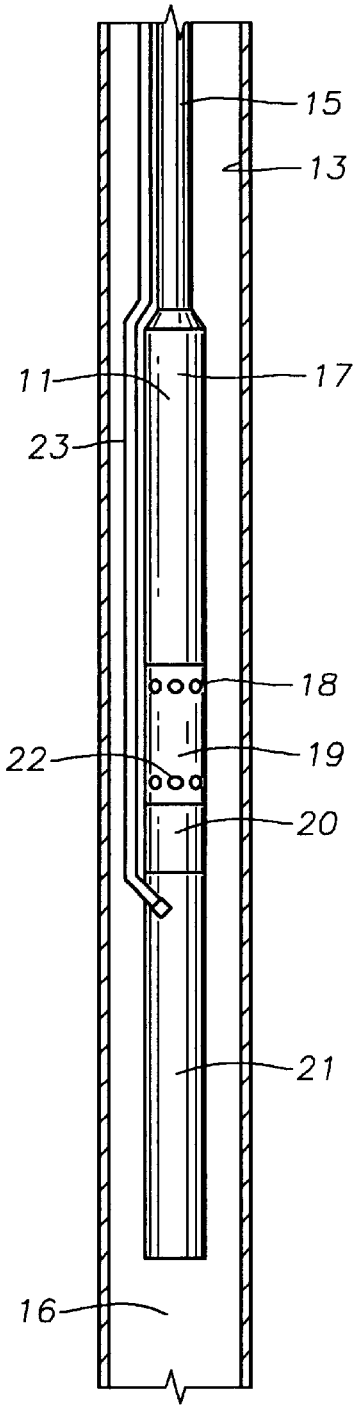
FIG. 2 is an enlarged schematic view illustrating the electrical submersible pump assembly installed in a well riser in accordance with this invention.
Figure 3:
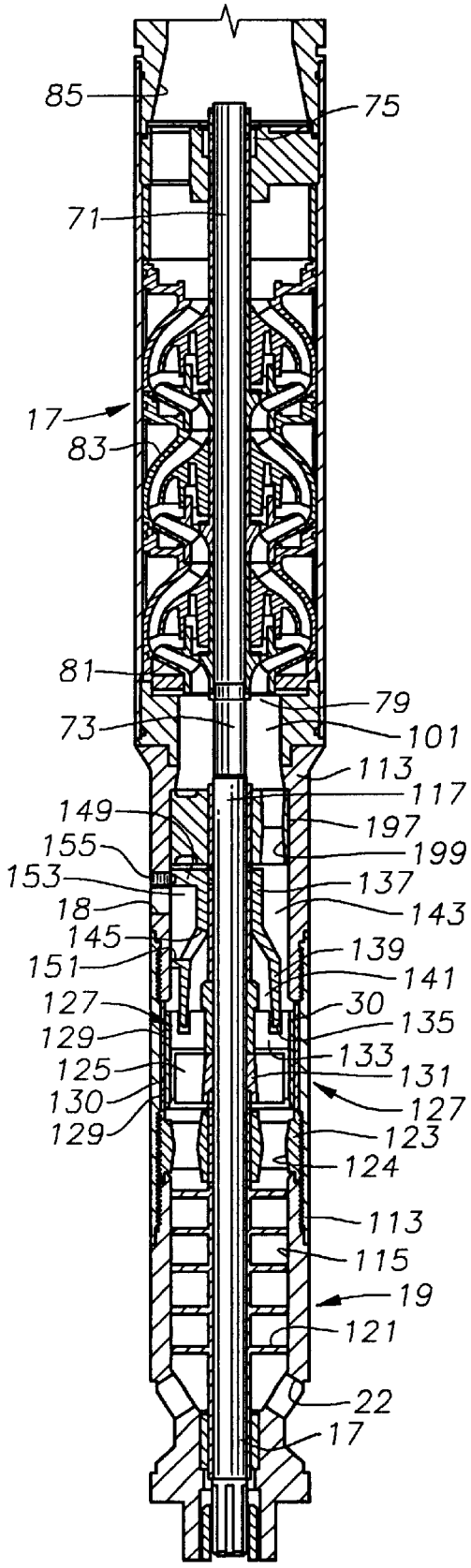
FIG. 3 is a sectional view of a lower portion of the pump of FIG. 1, which houses a rotating gas separator and a centrifugal pump.

In FIGS. 2 and 3, enlarged views of the electrical submersible pump assembly 11 are shown installed within the riser region of well 13. Referring to FIG. 3, rotating gas separator 19 has a cylindrical housing 113. Housing 113 has an axial inner passage 115. A shaft 117 will be driven by the motor 21 (FIG. 1) mounted below the gas separator and separated by the seal section 20 (FIG. 1). An inlet 22 locates in the bottom of the housing 113 for drawing well fluid 16 into passage 115.

The well fluid 16 proceeds first to an inducer 121. Inducer 121 comprises a helical screw mounted to the shaft 117 for rotation with it. Inducer 121 conveys the well fluid 16 upward and pressurizes the well fluid 16 to prevent expansion of the gas contained in the well fluid 16 at that point.

The well fluid 16 then passes through a bearing 123, which is of a spider type, having a plurality of passages 124. The well fluid 16 proceeds to a set of guide vanes 125. Guide vanes 125 are mounted to the shaft 117 for rotation therewith. Preferably, there are more than one of the guide vanes 125, each comprising a flat or curved plate, and each being inclined relative to the axis of shaft 117. Guide vanes 125 impart a swirling motion to the well fluid 16.

Guide vanes 125 are located in the lower portion of a rotor 127. Rotor 127 has an outer cylinder 129 which extends down over the guide vanes 125. Outer cylinder 129 encloses an inner hub 131 and is closely spaced within a stationary sleeve 130 mounted in the passage 115. Inner hub 131 mounts to the shaft 117 for rotation with the shaft 117. Two or more rotor vanes 133 (only two shown) extend between the hub 131 and the outer cylinder 129. Vanes 133 comprise longitudinal blades extending from the lower end to the upper end of the rotor 127. Each vane 133 is located in a radial plane of the axis of shaft 117. Each vane 133 is vertically oriented.

Each vane 133 preferably has a notch 135 formed in its upper end. Notch 135 is a longitudinal slot that extends downward from the upper edge of each vane 133. In the embodiment shown, each notch 135 is located approximately midway between the hub 131 and the outer cylinder 129. The notches 135 may also be positioned to one side or the other of the midpoint between the hub 131 and outer cylinder 129, depending on the amount of separation desired. The rotor 127 imparts a centrifugal force to the well fluid 16 causing heavier liquid components to flow outward toward the outer cylinder 129 as they progress up the rotor 127. The lighter gaseous phase will remain in the central portion of the rotor 127, near the hub 131.

A discharge member 137 mounts stationarily directly above rotor 127. Discharge member 137 does not rotate with shaft 117. Discharge member has a depending skirt 139 that extends downward. Skirt 139 is concentric with shaft 117. Skirt 139 is annular, having an outer diameter significantly smaller than the inner diameter of the passage 115 of housing 113. The inner diameter of skirt 139 is significantly greater than the outer diameter of inner hub 131. This results in an annular gas cavity 141 located within the skirt 139.

The clearance between the skirt 139 and the passage 115 comprises a liquid passage 143. The portion of the well fluid 16 that does not enter gas cavity 141 will flow up through the liquid passage 143. A plurality of gas passages 145 (only one shown) extend through discharge member 137. In the embodiment shown, there are three of the gas passages 145, and each communicates with the gas outlet 18 extending through housing 113. Gas outlets 18 allow separated gas to be discharged into the well.

Discharge member 137 has a plurality of laterally extending supports 149 (only one shown). In the embodiment shown, there are three supports 149 spaced 120 degrees apart from each other. The supports 149 extend out into contact with the passage 115. Each support has a generally rectangular perimeter, having flat upper and lower edges and side edges. The outer face of each support 149 is a segment of a cylinder having approximately the same diameter as the inner diameter of passage 115. The outer face of each support 149 extends circumferentially about 45 degrees.

A fluid in the liquid passage 143 flows between the supports 149. A window 151, which is rectangular in the embodiment shown, is located in the outer face of each support 149. Window 151 registers with one of the gas outlets 18 and communicates with a cavity 153 defined by the interior of each support 149. Window 151 and cavity 153 may be considered apart of the gas passage 145 leading to a gas outlet 18. A fastener, screw 155, or locking device extends through a hole in housing 113. The tip of screw 155 engages a dimple provided in one of the upper supports 149. This engagement prevents rotation of the discharge member 137 and also fixes the discharge member 137 axially.

A bearing 197 mounts in housing 113 above discharge member 137 for supporting shaft 117. Bearing 197 has one or more axial passages 199 for the flow of fluid. The fluid flows through a bore outlet 101 on the upper end into the intake 79 of the pump 17.

In operation, the well fluid 16 flows in intake 22. The inducer 121 will apply pressure to the well fluid, which then flows through guide vanes 125 into rotor 127. The spinning rotor provides some separation of the gas and liquid, with the heavier liquid components moving outward toward the outer cylinder 129.

The gaseous phase remains near inner hub 131 and will flow through the gas cavity 141, gas passage 145 and out the gas outlet 18 in the riser 13. The remaining portion of the well fluid 16 which may be a mixture of liquid and gas, will flow up the liquid passage 143 and through the bearing passage 199 into the bore outlet 101 into the intake 79 of the pump 17.

The pump 17 is conventional. The lower end of pump 17 has a pump intake 79 for supplying the liquid to be pumped by pump 17. Shaft 71 is coupled to the shaft 117 of the gas separator 19 by a coupling 73. Shaft 71 is driven by the electric motor 21, which rotates shaft 71 to drive pump 17. Pump 17 contains a large number of stages, each having an rotating impeller 81 and a stationary diffuser 83. The impellers 81 are mounted on the shaft 71. Pump 17 pumps liquid out a discharge end 85 and into the production tubing 15. The production tubing 15 terminates at the floating production platform 10. Near the discharge end 85 of the pump 17 is a fixed bearing 75 that aligns the shaft 71 and allows the shaft 71 to rotate. Alternatively, the pump assembly 11 could be suspended on coiled tubing, with well fluid flowing up riser 13 surrounding the coiled tubing.

Figure 4:
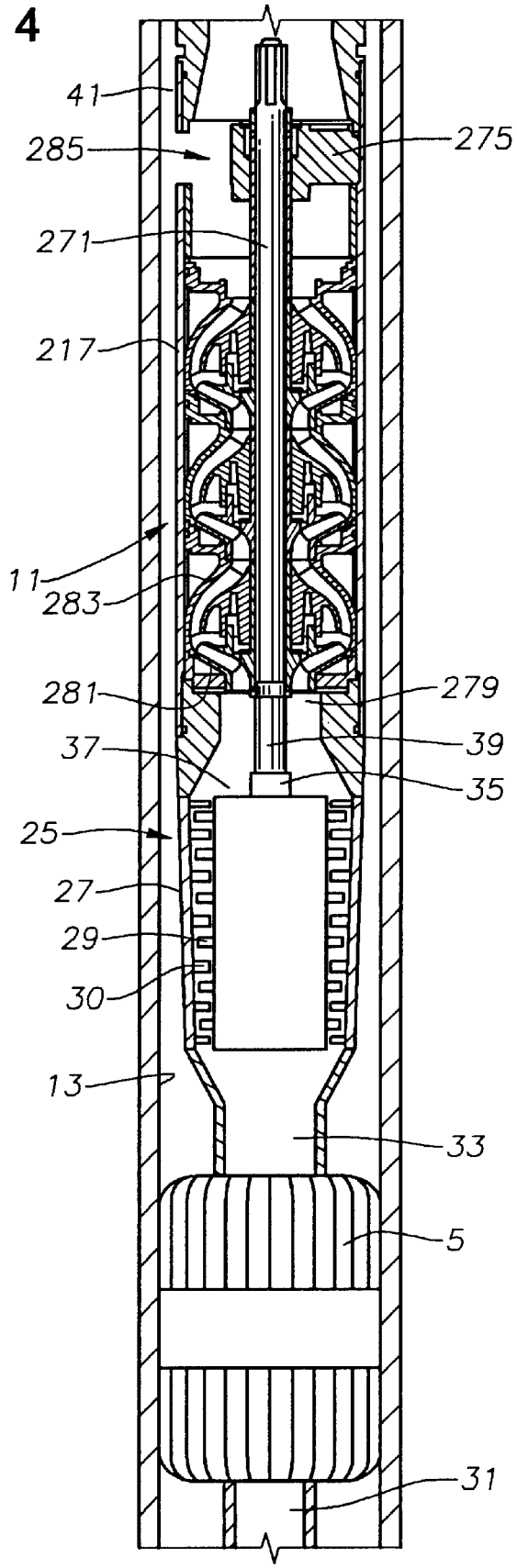
FIG. 4 is a sectional view of an alternate embodiment of a lower portion of the pump of FIG. 1, which houses a packer, NPSH stages, and a tapered pump.

FIG. 4 is a drawing of an alternate embodiment. In this embodiment the well fluid 16 enters a liquid inlet 31. The liquid inlet 31 is mounted below a packer 5 that provides a seal between the well riser region 13 and a fluid conduit 33. The liquid inlet 31 is fluidly linked with the fluid conduit 33. The fluid conduit 33 passes through the packer 5.

A gas conditioning stage 25 or NPSH stage is mounted at the top end of the fluid conduit 33. The gas conditioning stage 25 has a tubular housing 27 containing a large number of impellers 29. Impellers 29 are rotated within stator 30, which may also be referred to as a set of diffusers. A shaft 35 rotates impellers 29. Each stage of impeller 29 and stator 30 results in a greater increase in pressure. The gas conditioning stage 25 has an output 37 that is fluidly connected with the pump intake 79. The shaft 35 is mechanically coupled to the pump shaft 71 by a mechanical coupling 39.

The pump 217 has a pump intake 279 for supplying the liquid to be pumped by pump 217. Shaft 271 is coupled to the gas conditioning stage shaft 25 at the lower end and the shaft 271 is coupled to the electric motor (not shown) by a coupling (not shown). Shaft 271 is driven by the electric motor (not shown), which rotates shaft 271 to drive pump 217. Electric motor (not shown) is powered by a power cable (not shown). Pump 217 contains a large number of stages, each having a rotating impeller 281 and a stationary diffuser 283. The impellers 281 are mounted on the shaft 271. The stages at the lower end, near the inlet of the pump 217 have a larger volume than the stages at the upper end, near the outlet of the pump so that the liquid is compressed as it travels through the pump 217. Pump 217 pumps liquid out a discharge 285 and into an annulus 41 between the pump assembly 11 and the riser 13 above the packer 5. Pump 217 may be suspended on production tubing or on coiled tubing. The liquid travels up the annulus 41 of the riser 13 to the floating production platform 10. Near the discharge end 285 of the pump 217 is a fixed bearing 275 that aligns the shaft 271 and allows the shaft 271 to rotate.

The invention has significant advantages. By operating a submersible pump in the riser region, the amount of production can be significantly increased. Initially, many wells have adequate pressure to force the fluids up the riser without any assistance. However, as the well pressure drops over time, there is a need to artificially increase the pressure to aid oil production. In addition, as the production fluids flow up the well, the pressure drops and gases that were in solution become free gases. This invention is able to artificially boost the riser pressure to increase production and force some of the free gases back into solution. Another advantage is the ability of the pump to unload the riser of liquid in the event that a hydrate blockage occurs between the wellhead and the riser base.

While the invention is shown in only one of its forms, it should be apparent to those skilled in the art that it is not so limited, but is susceptible to various changes without departing from the scope of the invention. For example, a gas separator is not always required. Also, the upper end of the riser may be buoyant and located a short distance below sea level.

What is claimed is:

1. A subsea well production assembly for producing well fluid from a subsea well, comprising:

a riser extending upward from the well to at least near sea level and having an upper end;

an electrical centrifugal pump suspended within the riser for pumping the well fluid up the riser.

2. The submersible well production assembly according to claim 1, wherein the pump is located nearer the well than the upper end of the riser.

3. The submersible well production assembly according to claim 1, further comprising a production tubing fluidly linked to the pump to transport the well fluid up the riser.

4. The submersible well production assembly according to claim 1, further comprising a separator within the riser mounted below the pump which separates gas from the well fluid.

5. The submersible well production assembly according to claim 4, wherein the separator is a rotating gas separator.

6. The submersible well production assembly according to claim 1, further comprising a packer sealing the pump to the riser, with an intake of the pump located below the packer and a discharge of the pump located above the packer.

7. The submersible well production assembly according to claim 1, wherein the pump has a discharge that discharges into an annulus in the riser.

8. The submersible well production assembly according to claim 1, wherein the pump has tapered stages with larger volume stages near an inlet of the pump and smaller volume stages near an outlet of the pump.

9. The submersible well production assembly according to claim 1, wherein the pump has at least one NPSH stage near an inlet of the pump.

10. In a subsea well production assembly having a wellhead at a sea floor, a riser extending upward from the sea floor to at least near sea level, the improvement comprising:

a tubing extending through the riser from an upper end of the riser to the proximity of the wellhead; and a centrifugal pump assembly secured to the lower end of the tubing above the wellhead for pumping well fluid upward from the wellhead to the upper end of the riser.

11. The subsea well production assembly according to claim 10, wherein the pump assembly is located between about 0 meters above the wellhead to about 100 meters above the wellhead.

12. The subsea well production assembly according to claim 10, further comprising a packer located between a pump inlet and a pump outlet, the packer sealing the pump assembly to the riser, the pump assembly having a discharge into an annulus in the riser surrounding the tubing.

13. The subsea well production assembly according to claim 10, further comprising a separator mounted in the pump assembly for separating gas from the well fluid.

14. The subsea well production assembly according to claim 10, wherein the pump assembly has a discharge into the tubing.

15. The subsea well production assembly according to claim 10, wherein the pump assembly has a pump with tapered stages, with larger volume stages near an inlet of the pump and smaller volume stages near an outlet of the pump.

16. The subsea well production assembly according to claim 10, wherein the pump assembly has at least one NPSH stage near an inlet of the pump assembly.

17. A method for producing well fluid from a subsea well, comprising:

(a) installing a riser from a wellhead near the sea floor with an upper end at least near sea level;

(b) suspending an electrical centrifugal pump in the riser; and (c) pumping well fluid up the riser with the pump.

18. The method according to claim 17, further comprising the step of:

installing a separator below the pump and separating gas from the well fluid prior to entering the pump.

19. The method according to claim 17, wherein step (b) comprises suspending the pump on a tubing and step (c) comprises pumping the well fluid up the tubing.

20. The method according to claim 17, wherein step (b) comprises suspending the pump on a tubing and step (c) comprises pumping the well fluid up an annulus in the riser surrounding the tubing.

* * * * *

UNITED STATES PATENT AND TRADEMARK OFFICE

CERTIFICATE OF CORRECTION

PATENT NO. : 6,412,562 B1
DATED : July 2, 2002
INVENTOR(S) : Christopher K. Shaw It is certified that error appears in the above-identified patent and that said Letters Patent is hereby corrected as shown below:

Column 3,
Line 48, after "considered" delete "apart" and insert therefor -- a part --

Signed and Sealed this

Seventeenth Day of September, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,412,562 B1 
DATED : July 2, 2002
INVENTOR(S) : Christopher K. Shaw and Bernie Fay It is certified that error appears in the above-identified patent and that said Letters Patent is hereby corrected as shown below:

Title page,
Item [75], Inventor: after "Christopher K. Shaw, Claremore, OK (US)," please add the co-inventor -- Bernie Fay, Surrey, England (UK) --

Signed and Sealed this

Seventh Day of January, 2003

JAMES E. ROGAN
*Director of the United States Patent and Trademark Office*